United States Patent [19]

Shibuya

[11] Patent Number: 4,478,401

[45] Date of Patent: Oct. 23, 1984

[54] APPARATUS FOR FEEDING SHEETS

[75] Inventor: Kunihiro Shibuya, Yokohama, Japan

[73] Assignee: Tokyo Shibaura Denki Kabushiki Kaisha, Japan

[21] Appl. No.: 357,087

[22] Filed: Mar. 11, 1982

[30] Foreign Application Priority Data

Mar. 19, 1981 [JP] Japan ..... 56-40109

[51] Int. Cl.[3] ..... B65H 3/32

[52] U.S. Cl. ..... 271/22; 271/127; 271/160; 271/164

[58] Field of Search ..... 271/22, 157, 160, 162, 271/164, 170, 126, 127

[56] References Cited

U.S. PATENT DOCUMENTS

| | | | |
|---|---|---|---|
| 4,017,181 | 4/1977 | Komaba | 271/162 X |
| 4,023,792 | 5/1977 | Punnett | 271/127 X |
| 4,221,375 | 9/1980 | Morrison | 271/162 X |
| 4,254,202 | 3/1981 | Matsumoto | 430/120 |

FOREIGN PATENT DOCUMENTS

| | | |
|---|---|---|
| 1957019 | 7/1976 | Fed. Rep. of Germany . |
| 2701454 | 7/1978 | Fed. Rep. of Germany . |
| 48-7752 | 1/1973 | Japan . |

*Primary Examiner*—Richard A. Schacher

*Attorney, Agent, or Firm*—Cushman, Darby & Cushman

[57] ABSTRACT

A feeding apparatus comprises a sheet cassette which stores and supports sheets P therein so that the sheets P can move between a feeding position and a non-feeding position, and is inserted into a housing of a copying machine, coil springs provided in the sheet cassette for biasing the sheets P from non-feeding position toward the feeding position, sheet feeding rollers provided in a fixed position and engaging a sheet P brought to the feeding position by the coil spring to feed the sheet P in the sheet cassette to the housing, engaging rollers at a fixed position in the housing, and levers defining cam surfaces which cooperate with the engaging rollers to move and thus isolate the sheets P from the sheet feeding rollers as the cassette is inserted into the housing, by engaging the cam section with the engaging roller.

12 Claims, 9 Drawing Figures

APPARATUS FOR FEEDING SHEETS

BACKGROUND OF THE INVENTION

This invention relates to a sheet feeding apparatus e.g. for feeding a copying machine with copying sheets, more specifically to an apparatus for feeding sheets provided with a detachable sheet storage box.

As a sheet feeding apparatus for feeding a copying machine with copying sheets one by one, there is generally used an apparatus which is provided with a cassette as a sheet storage box to be detachably set in the storage portion inside the housing of the copying machine. According to such a sheet feeding apparatus, the copying sheets in the cassette are fed one by one into the housing by means of sheet feeding rollers as sheet feeding means disposed in the housing. Thereupon, in order to ensure the sheet feeding operation, it is necessary to produce a given friction between the copying sheet and the feeding rollers. Springs are generally used as means for producing the friction. At present, the space for the springs is set inside the cassette according to one type of apparatus, and inside the copying machine according to another. Simpler in construction, the latter type is widely put to practical use.

In the sheet feeding apparatus of the type using the springs in the cassette, however, the sheet feeding rollers must be kept away from the front end edge of a pile of copying sheets stored in the cassette when inserting the cassette into the housing. On the other hand, the sheet feeding rollers need be in contact with the uppermost one of the stored copying sheets on completion of the insertion of the cassette into the housing. It is therefore necessary to provide a mechanism for letting the sheet feeding rollers escape upward lest they should come into contact with the copying sheets inside the housing at the cassette insertion.

Recently, there has been a tendency to reduce the size of the copying machine. The copying machine of the aforementioned type cannot, however, be reduced in height due to the space for letting the sheet feeding rollers escape, thus failing to meet the requirement for the miniaturization.

SUMMARY OF THE INVENTION

This invention is contrived in consideration of above mentioned circumstances, and is intended to provide an apparatus for feeding sheets capable of inserting a sheet storage box without bringing sheets therein into contact with sheet feeding means, despite the elimination of a mechanism for letting the sheet feeding means escape.

According to an aspect of this invention, there is provided an apparatus for feeding sheets which comprises a sheet storage box which stores and supports therein sheets so that the sheets can move between a feeding position and a non-feeding position, and is inserted into a to-be-fed section, biasing means provided in the sheet storage box for biasing the sheets from the non-feeding position toward the feeding position, sheet feeding means engaging a sheet brought to the feeding position by the biasing means to feed the sheet in the sheet storage box to the to-be-fed section, and isolating means for isolating the sheets from the sheet feeding means as the sheet storage box is inserted into the to-be-fed section, wherein the sheet feeding means includes at least one sheet feeding roller in a fixed position, and the isolating means includes an engaging means for moving the sheets from the feeding position to the non-feeding position against the biasing force of the biasing means.

DETAILED DESCRIPTION OF THE PREFERRED EMBODIMENTS

Now there will be described a sheet feeding apparatus according to one embodiment of this invention applied to an electrostatic copying machine with reference to the accompanying drawings.

Figure 1:
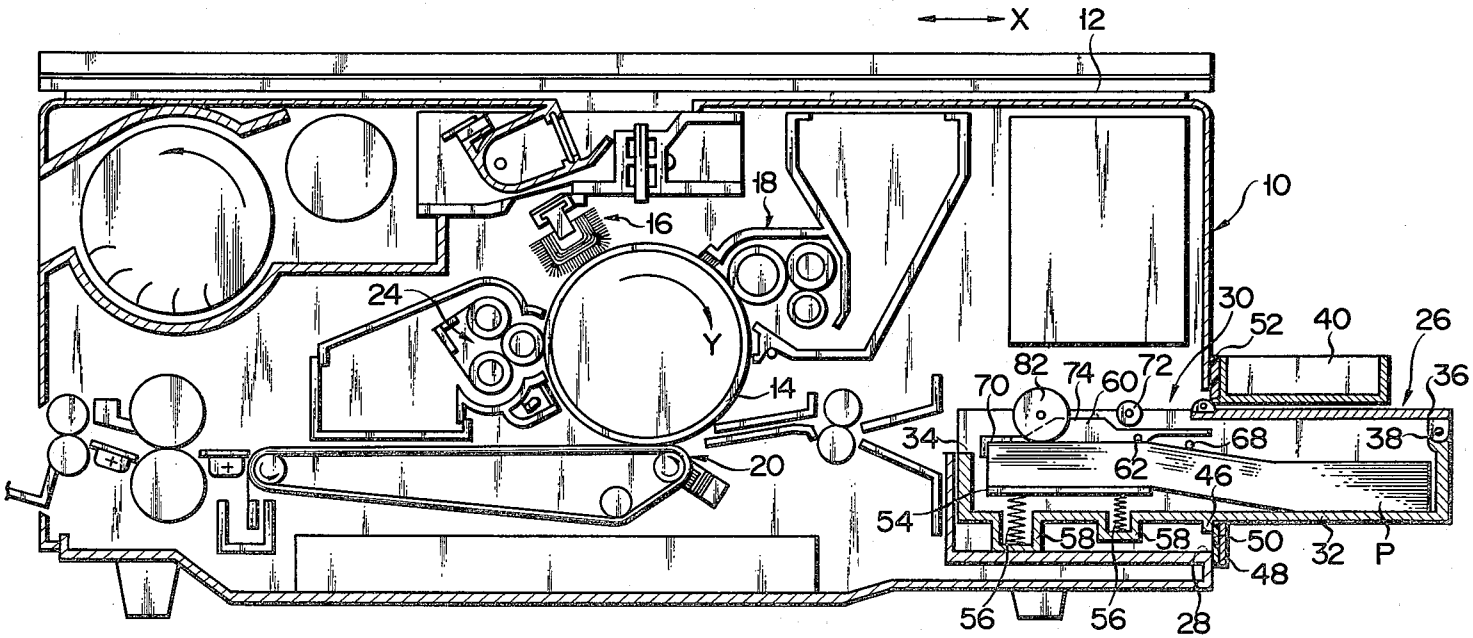
FIG. 1 is a side sectional view showing a sheet feeding apparatus according to one embodiment of this invention, along with an electrostatic copying machine to which the apparatus is applied.

In FIG. 1, reference numeral 10 designates a housing of the electrostatic copying machine. A document table 12 is mounted on the top surface of the housing 10 to reciprocate along the direction shown by an arrow X. A photoconductive drum 14 is disposed substantially in the central portion of the interior of the housing 10 to rotate clockwise or in the direction of an arrow Y. A charger 16, a developing unit 18, a transfer-separator 20, a discharger 22, and a cleaning unit 24 are arranged successively around the photoconductive drum 14 along the rotating direction thereof. Formed in one side wall of the housing 10 is an inlet slot 28 through which a sheet cassette 26, as described in detail later, is inserted into the copying machine.

The sheet feeding apparatus 30 is disposed in the vicinity of the inlet slot 28 inside the housing 10. The sheet feeding apparatus 30 is provided with the sheet cassette 26 as a sheet storage box, the front portion of which is inserted in the housing 10 through the inlet slot 28. The sheet cassette 26 stores therein a pile of copying paper or sheets P, and is detachable from the housing 10.

Figure 2:
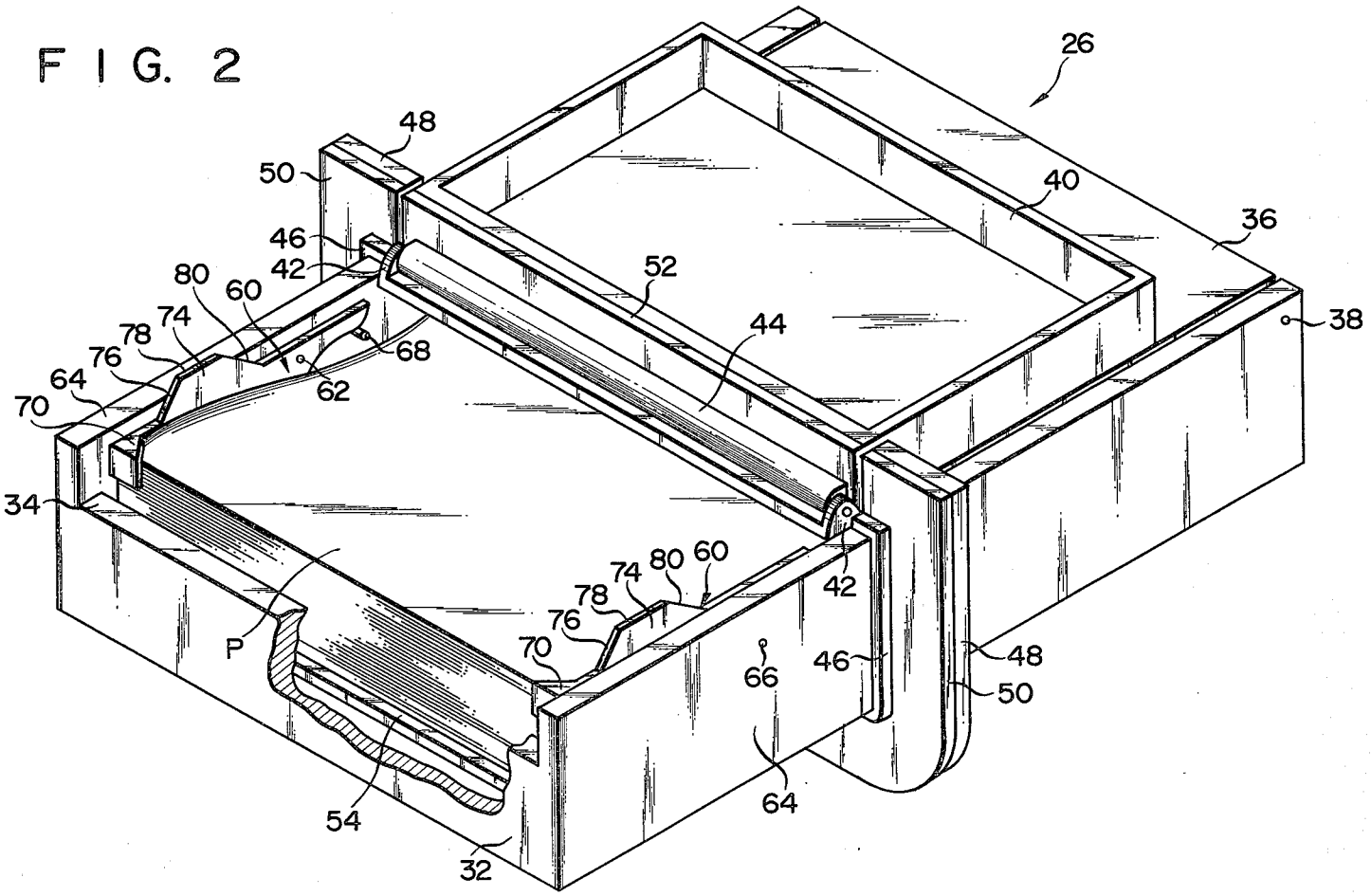
FIG. 2 is a perspective view extractively showing a sheet cassette shown in FIG. 1.

As extractively shown in FIG. 2, the sheet cassette 26 has a thin, box-shaped frame 32 with open top. An opening 34 is formed in the upper portion of the front wall of the frame 32. The rear half portion of the top opening of the frame 32 is overlaid with a cover 36. The rear end portion of the cover 36 is pivotally supported on the rear end portion of the frame 32 by means of pins 38 so that the cover 36 may be rocked as required to open the rear half portion of the top opening of the frame 32.

An auxiliary cover 40 is pivotally attached to the front end edge of the cover 36 to cover the front half portion of the top opening of the frame 32. A pair of upright strips 42 are arranged at both ends of the front end edge of the cover 36, severally. A fitting block 44 is attached to the front end portion, as in FIG. 2, of the auxiliary cover 40 (or the rear end portion of the auxiliary cover 40 overlying the front half portion of the top opening of the frame 32), held between the two upright strips 42. The fitting block 44 is rockably supported between the upright strips 42 by fitting pins at both ends of the fitting block 44 in holes formed in the upright strips 42.

An outwardly projected ridge 46 is formed integrally over the outer peripheries of both side walls and the bottom plate of the frame 32. The frame 32, moreover, is detachably fitted with a U-shaped screen plate 48 which is outwardly projected beyond the ridge 46, and embracing both side walls and the bottom plate of the frame 32. The front of the screen plate 48 and the front (in FIG. 2) of the auxiliary cover 40 are wholly covered with cushion members 50 and 52, respectively. The ridge 46, which is in contact with the screen plate 48, is intended to regulate the position of the screen plate 48 so that the cushion member 52 on the auxiliary cover 40 is flush with the cushion member 50 on the screen plate 48. The positions of the cushion members 50 and 52 are so regulated that they may be in contact with that one side wall of the housing 10 in which the inlet slot 28 is formed at the time when the insertion of the sheet cassette 26 into the housing 10 is completed.

Turning again to FIG. 1, a supporting plate 54 to support the front end portion of the pile of copying sheets P stored in the sheet cassette 26 provided in the frame 32. The supporting plate 54 is vertically movably mounted above the inner bottom surface of the frame 32. A plurality of coil springs 56 as biasing means are interposed between the supporting plate 54 and the bottom plate of the frame 32 so that the supporting plate 54 is elastically supported above the bottom plate by these springs 56. The coil springs 56 are cylindrical in external shape, having their lower ends fitted severally in depressions formed in the bottom plate of the frame 32.

Levers 60 are rockably attached to the inner surfaces of both side walls 64 of the frame 32 along the insertion direction of the cassette 26. At the rear portion of each lever 60, a pin 62 is projected toward its corresponding side wall 64. On the other hand, a perforation 66 to receive the pin 62 is formed in each side wall 64, and each lever 60 is pivotally mounted on its corresponding side wall 64 with the pin 62 fitted in the perforation 66. A stop pin 68 as a stopper protrudes inward from that portion of each side wall 64 which corresponds to the under side of the rear end portion of each lever 60, as the lever 60 is held horizontally. Thus, the lever 60 in its horizontal position is prevented from rocking in the clockwise direction of FIG. 1, but is allowed to rock counterclockwise.

Figure 3:
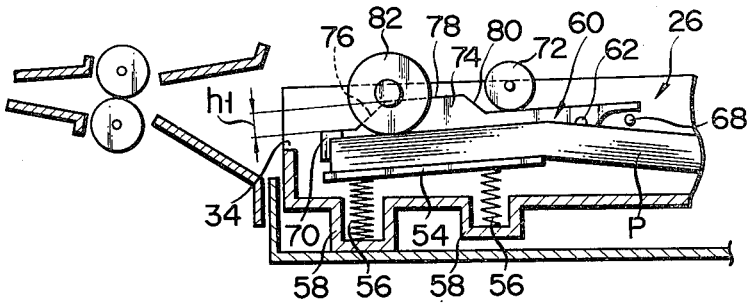
FIG. 3 is a partial side sectional view showing a state after the insertion of the sheet cassette is completed.

The front end of each lever 60 extends up to the front end of the stored pile of copying sheets P. At the front end of each lever 60 is formed a separating claw 70 to engage its corresponding corner portion of the front end of part of the pile of copying sheets P. Further, a cam section 74 as one integrant part of engaging means is integrally formed on the upper side of each lever 60 at that portion thereof which is to be located ahead of an engaging roller 72 as mentioned later, after the sheet cassette 26 is fully inserted in the housing 10, as shown in FIG. 3. The cam section 74 is substantially in the shape of an isosceles trapezoid, including a first cam portion 76 having a first cam surface ascending from the top surface of the lever 60, a second cam portion 78 having a second cam surface projected to a given height h1 above the top surface of the lever 60 and extending parallel thereto, and a third cam portion 80 having a third cam surface descending to the top surface of the lever 60, those cam portions ranging from the front portion of the lever 60 toward the rear.

Meanwhile, a plurality of sheet feeding rollers 82 as sheet feeding means, arranged along the direction normal to the direction of cassette insertion, are rotatably disposed inside the housing 10 to come frictionally in contact with the front portion of the top surface of the stored pile of copying sheets P after the sheet cassette 26 is fully inserted in the housing 10, as shown in FIG. 3. The sheet feeding rollers 82 are driven by a driving mechanism (not shown) to rotate in the clockwise direction of FIG. 3, and the copying sheets P are fed one by one into between the photoconductive drum 14 and the transfer-separator 20 as the sheet feeding rollers 82 rotate. Each sheet feeding roller 82 is attached to fixed position on the guide member (not shown) of the housing 10. The fitting positions of the sheet feeding rollers 82 are so set that the bottom ends of the sheet feeding rollers 82 are located below the top surface of the stored pile of copying sheets P by a vertical distance h2 at the start of the insertion of the sheet cassette 26 into the housing 10 through the inlet slot 28.

Further, the engaging roller 72 as another integrant part of the engaging means is disposed inside the housing 10 to engage the cam section 74 of each lever 60 as the sheet cassette 26 is being inserted into the housing 10. The engaging roller 72 is located nearer to the inlet slot 28 than the sheet feeding rollers 82 are, and is rockably mounted on the guide member (not shown) of the housing 10.

Figure 4:
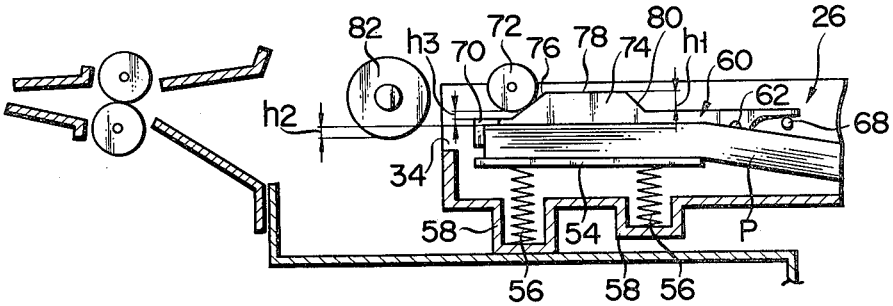
FIG. 4 is a partial side sectional view showing a state at the start of the insertion of the sheet cassette.
Figure 5:
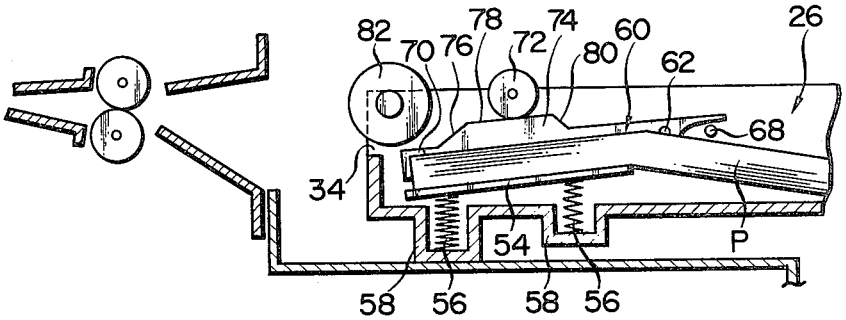
FIG. 5 is a partial side sectional view showing a state during the insertion of the sheet cassette.

Hereupon, the distance between the engaging roller 72 and each of the sheet feeding rollers 82 is so set that the front end of the stored pile of copying sheets P may be located under the sheet feeding rollers 82 when the engaging roller 72 engages the second cam portion 78 of the cam section 74, as shown in FIG. 5, and that the engaging roller 72 may engage the first cam portion 76 of the cam section 74 before the front end of the stored pile of copying sheets P comes into contact with the sheet feeding rollers 82, as shown in FIG. 4. As shown in FIG. 3, moreover, the third cam portion 80 is so positioned that it may be disengaged from the engaging roller 72 by the time the insertion of the sheet cassette 26 is completed.

The fitting position of the engaging roller 72 is so set that the bottom end of the engaging roller 72 is located above the top surface of the lever 60 by a vertical distance h3 at the start of the insertion of the sheet cassette 26 into the housing 10 through the inlet slot 28, as shown in FIG. 4. Here the height h1 is greater than the distance h3, and the difference between h1 and h3 is greater than the distance h2. That is, there are relations as follows:

$$h1 > h3,$$

$$h1 - h3 > h2.$$

There will now be described the operation of the apparatus of the above-mentioned construction.

First, the cover 36 is rocked around the pins 38 to open the top of the sheet cassette 26, and the pile of copying sheets P is placed in the cassette 26 with its front portion supported on the supporting plate 54. Then, both levers 60 are once rocked broadly in the clockwise direction to cause their respective separating claws 70 to engage their corresponding corners of the front end portion of the stored pile of copying sheets P. The separating claws 70 depress by their own weight the corners of the front end portion of the uppermost sheet out of the pile of copying sheets P.

Then, the cover 36 is restored to close the rear half portion of the top opening of the frame 32. Hereupon, the auxiliary cover 40 is left on the cover 36, that is, the front half portion of the top opening of the frame 32 is left open.

In this state, the sheet cassette 26 is inserted into the housing 10 through the inlet slot 28 thereof. Accompanying the insertion, the two engaging rollers 72 first engage the first cam portions 76 of their corresponding cam sections 74, as shown in FIG. 4, respectively. Accordingly, the levers 60 having the cam sections 74 thereon are urged to rock counterclockwise around their corresponding pins 62 according to the inclination of the first cam portions 76. Thus, the pile of copying sheets P is pressed downward against the biasing force of the coil springs 56 by the separating claws 70 at the front ends of the levers 60.

When the respective second cam portions 78 of the two cam sections 74 are brought into contact with their corresponding engaging rollers 72, as shown in FIG. 5, the upper end edge of the pile of copying sheets P is located below the bottom end portions of the sheet feeding rollers 82. In this state, the sheet cassette 26 is further inserted to locate the sheet feeding rollers 82 over the front portion of the pile of copying sheets P. Further continuation of insertion of the sheet cassette 26 causes the engaging rollers 72 to be disengaged from the second cam portions 78 of their corresponding cam sections 74. Accordingly, the levers 60 having the cam sections 74 thereon are rocked clockwise around their corresponding pins 62 by the biasing force of the coil springs 56, according to the inclination of the third cam portions 80. Then, the uppermost sheet out of the pile of copying sheets P is brought into contact with the sheet feeding rollers 82, as shown in FIG. 3. In this state, the insertion of the sheet cassette 26 into the housing 10 is completed.

In the state of FIG. 3 in which the sheet cassette 26 is fully inserted, the uppermost one of the copying sheets P stored in the cassette 26 is ready to be fed as the sheet feeding rollers 82 rotate. In this fully inserted state, moreover, the engaging rollers 72 are isolated from the top surfaces of their corresponding levers 60. Thus, the copying sheets P and the sheet feeding rollers 82 are allowed to be in contact under a given pressure without being blocked by the engaging rollers 72.

On the other hand, the sheet cassette 26 may be removed from the housing 10 by inversely following the aforementioned processes of operation for the insertion.

In the insertion into or removal of the sheet cassette 26 from the housing 10 of the electrostatic copying machine, as described above, the forward end portion of a pile of copying sheets P is once pressed downward from the sheet feeding rollers 82 by the engagement of the engaging rollers 72 with the cam sections 74 of the levers 60 having the separating claws 70 at the front ends. Accordingly, the insertion and removal of the sheet cassette 26 may satisfactorily be executed even though the sheet feeding rollers 82 are in fixed positions. Thus, in the insertion and removal of the sheet cassette 26, it is unnecessary to use the space and mechanism for once letting the sheet feeding rollers 82 escape, which are required of the prior art apparatus. As a result, the housing 10 can enjoy compact design. Moreover, the elimination of the escape mechanism for the sheet feeding rollers 82 and the driving system therefor leads to a reduction in cost of the electrostatic copying machine.

In the aforementioned fully inserted state of the sheet cassette 26, furthermore, the cushion member 52 on the auxiliary cover 40 and the cushion member 50 on the screen plate 48 abut on the periphery of the inlet slot 28 of the housing 10 to close the inlet slot 28. The pile of copying sheets P located inside the housing 10, therefore, is cut off from the outside air, and is protected against moisture therefrom. Such protection of the copying sheets against moisture may ensure stable transfer conditions. Since the inlet slot 28 is fully closed by the auxiliary cover 40 and the screen plate 48, moreover, there will be no fear of the copying sheets becoming moist even if the inlet slot 28 is wide. By the use of the wide inlet slot 28, therefore, the insertion of the sheet cassette 26 into the housing 10 may be improved in smoothness.

This invention is not limited to the arrangement of the above-mentioned embodiment, and various changes and modifications may be effected by one skilled in the art without departing from the scope or spirit of the invention.

For example, the sheet feeding apparatus 30 may be applied to copying machines of any types, whether ammonia-process type or semimoist-process type, as well as to the electrostatic copying machine.

Further, the cushion members 50 and 52, which are attached to the auxiliary cover 40 and the screen plate 48 in the above embodiment, may alternatively be attached to that portion of the one side wall of the housing 10 which surrounds the inlet slot 28.

In the above-mentioned embodiment, moreover, the cam sections 74 and the engaging rollers 72 as the engaging means are attached to the levers 60 in the sheet cassette 26 and to the housing 10, respectively. The levers 60 in the cassette 26 and the housing 10 may, however, be fitted with the engaging rollers 72 and the cam sections 74, respectively.

Figure 6:
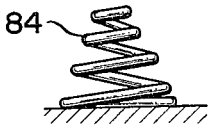
FIG. 6 is an extractive side view of a coil spring used in another embodiment of the invention.
Figure 7:
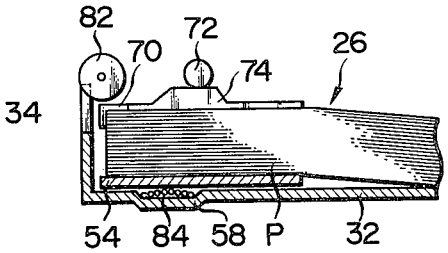
FIG. 7 is a side sectional view of a sheet cassette using the coil spring shown in FIG. 6.
Figure 8:
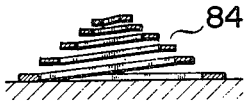
FIG. 8 is a sectional view of a coil spring used in a first modification of the another embodiment.
Figure 9:
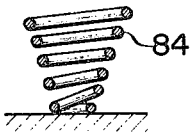
FIG. 9 is a sectional view of a coil spring used in a second modification of the another embodiment.

Further, the cylindrical coil spring 56 as the biasing means may be replaced with a conical coil spring 84, as shown as the another embodiment of the invention in FIG. 6. When compressed, the conical coil spring 84 may be made substantially flat, practically losing its height, as shown in FIG. 7. Accordingly, the depth of the depression 58 for containing the coil spring 84, and hence the height of the frame 32 of the cassette 26, may be reduced. In consequence, the housing 10 of the copying machine in which the cassette 26 of the reduced height or thickness is inserted can be reduced in height and improved in compactness. The sectional shape of the conical coil spring 84 is not limited to the circular configuration, and may be any other configuration, e.g., rectangular, as shown as a first modification in FIG. 8. As shown as a second modification in FIG. 9, moreover, the conical coil spring 84 may be set upside down in use without attenuating it effect.

Furthermore, the cam section 74 need not always be in the shape of a trapezoid. For example, it may have a semicircular shape or a shape corresponding to a half cycle of a sine curve.

What is claimed is:

1. An apparatus for feeding sheets, comprising:

a sheet storage box which stores and supports a stack of sheets, said stack of sheets being moveable between a feeding position and a non-feeding position in the sheet storage box;

housing means defining an insertion port through which the sheet storage box is inserted into the housing in an inserting direction which traverses a line extending from the feeding position to the non-feeding position, said storage box being removeably maintained in an inserted position at said insertion port;

biasing means provided in said sheet storage box, for biasing the stack of sheets in a direction from the non-feeding position toward the feeding position to bias the stack of sheets into the feeding position;

sheet feeding means provided in the housing, for engaging the uppermost sheet brought to the feeding position by said biasing means in order to feed the uppermost sheet in said sheet storage box to the housing, said sheet feeding means including at least one sheet feeding roller in a fixed position; and isolating means for moving the stack of sheets from the feeding position to the non-feeding position in response to said sheet storage box being inserted, in the inserting direction, into the insertion port of said housing and for moving the stack of sheets from the non-feeding position to the feeding position when said storage box is moved into said inserted position, wherein said isolating means includes engaging means for moving the sheets from the feeding position to the non-feeding position against the biasing force of said biasing means in response to said sheet storage box being inserted into the housing.

2. The apparatus according to claim 1, wherein said engaging means includes at least one lever movably disposed inside said sheet storage box to be brought into contact with the top of the stored sheets, an engaging member attached to said housing, and cam means operatively associated with said at least one lever for defining a cam surface which engages said engaging member in response to said storage box being moved into said insertion port in said insertion direction to cause said lever to move the stack of sheets from the feeding position to the non-feeding position as said cam section engages said engaging member.

3. The apparatus according to claim 2, wherein said engaging member is provided in a fixed position in the housing, and said cam surface is defined on the top surface of said at least one lever.

4. The apparatus according to claim 3, wherein said engaging member includes a rotatable engaging roller.

5. The apparatus according to claim 3, wherein said sheet feeding roller has its bottom end located below the top of the sheets stored in said sheet storage box being inserted, and said cam means defines a cam surface high enough to cause said lever to locate the top of the sheets below the bottom end of said sheet feeding roller when said cam means engages said engaging member.

6. The apparatus according to claim 2, wherein two levers are arranged severally at both end portions of the stored sheets along the feeding direction.

7. The apparatus according to claim 6, wherein each said lever has a separating claw at one end to engage each corresponding front corner portion of the stored sheets, and a pin at the other end pivotally mounted on a side wall of said sheet storage box.

8. The apparatus according to claim 1, wherein said sheet storage box includes a supporting plate to support the front portion of the stored sheets.

9. The apparatus according to claim 8, wherein said biasing means includes a plurality of coil springs supporting said supporting plate.

10. The apparatus according to claim 9, wherein each said coil spring is cylindrical, and said sheet storage box has depressions at the bottom to receive the lower end portions of said coil springs, severally.

11. The apparatus according to claim 9, wherein each said coil spring is a conical spring which is made substantially flat when compressed.

12. An apparatus for successively feeding sheets in a sheet by sheet manner from a stack of sheets, said apparatus comprising:

a housing defining a slot and including feeding means engageable with the stack of sheets for successively feeding the sheets in a sheet by sheet manner;

storage means for storing and supporting the stack of sheets and insertable into said slot in an insertion direction so as to be removeably maintained in said slot in an inserted position, said storage means including a base upon which at least the front portion of said stack of sheets is supported, biasing means connected to said base for biasing at least the front portion of said stack of sheets in a biased direction so that said stack of sheets is biased into a feeding position with said feeding means when said storage means is in said inserted position; and cam means operatively associated with said housing and said base for (a) displacing said base in a direction opposing said biased direction to thereby displace at least the front portion of the stack of sheets into a non-feeding position in response to said storage means being inserted in said slot and moved to a first position therein to isolate at least the forward portion of the stack of sheets and said feeding means, and thereafter (b) permitting said bias means to bias said base and thus at least the front portion of the stack of sheets into said feeding position in response to said storage means being moved in said insertion direction from said first position to a second position downstream of said first position.

* * * * *